United States Patent [19]

Akkerman

[11] 4,103,744

[45] Aug. 1, 1978

[54] SAFETY VALVE AND BALL TYPE EQUALIZING VALVE

[75] Inventor: Neil H. Akkerman, New Orleans, La.

[73] Assignee: Baker International Corporation, Orange, Calif.

[21] Appl. No.: 821,656

[22] Filed: Aug. 4, 1977

[51] Int. Cl.[2] ..... E21B 43/12

[52] U.S. Cl. ..... 166/324; 166/332; 137/629; 251/347; 251/353

[58] Field of Search ..... 166/324, 328, 329, 332–334; 251/347, 349, 353; 137/629, 630.15, 601, 599.1

[56] References Cited

U.S. PATENT DOCUMENTS

| | | | |
|---|---|---|---|
| 2,133,272 | 10/1938 | Coberly | 166/332 |
| 3,078,923 | 2/1963 | Tausch | 166/324 |
| 3,249,124 | 5/1966 | Berryman | 251/347 |
| 3,971,438 | 7/1976 | Crowe | 166/324 |

*Primary Examiner*—James A. Leppink
*Attorney, Agent, or Firm*—Subkow and Kriegel

[57] ABSTRACT

An equalizing valve is incorporated in a subsurface shutoff valve for wells and has a number of balls loosely confined in an annular groove in the tubular valve body and adapted to seat in by-pass ports in the shutoff valve actuator piston sleeve to prevent flow through such by-pass ports from ports in the valve body which communicate with the groove. Actuation of the piston sleeve to open the shutoff valve causes a shoulder forming the groove to wipe the seated balls from the by-pass ports to equalize fluid across the shutoff valve before it is opened. The shutoff valve is of the ball type or of another type. The shutoff valve of the ball type, when closed, subjects its support bars to a force deforming them to allow the shutoff valve ball to move into seating engagement with a seating sleeve to prevent extrusion of an elastomer seal.

35 Claims, 27 Drawing Figures

SAFETY VALVE AND BALL TYPE EQUALIZING VALVE

In the production of well fluids, such as oil and/or gas, from wells situated at remote locations, it has become the practice to employ automatic shutoff valves which are responsive to the pressure of well fluids, so as to be actuated from an opened condition to a closed condition in the event of loss of well fluids, as may be caused by various circumstances. For example, it may occur that a well located at sea may suffer damage which would allow well fluids to flow into the sea, not only resulting in loss of well fluids until the well can be killed, but also resulting in contamination of the seawater and the seashore when oil escapes into the sea and drifts ashore. It is also desirable to prevent the uncontrollable loss of well fluids from remotely located onshore wells where damage may occur to the wellhead equipment, resulting in the uncontrolled flow of the well until it can be killed.

Various valves have been heretofore developed for the purposes of automatically shutting off such a flowing well, at a subsurface location in the production pipe string, including sleeve type valves, flap type valves, and ball type valves which have a substantially full bore opening therethrough and thereby cause no substantial restrictions to flow. However, such subsurface valves experience operating difficulties, particularly when they are being opened and the well fluid pressure below the valve, which is holding the valve closed, is substantial, causing a high friction loading between the sealing faces and surface of the ball with which they are sealingly engaged or causing high resistance to valve opening movement in general. Indeed, the operating means for shifting the valve to an open position may, in some instances, be destroyed.

Accordingly, subsurface valves have evolved wherein a balancing valve or by-pass valve equalizes the fluid pressure across the closed shutoff valve before the shutoff valve is opened, thereby reducing the wear and frictional resistance to valve actuation. As examples of such prior valves incorporating by-pass or equalizing valves, reference is made to U.S. Pat. No. 3,971,438, granted July 27, 1976 for "Wireline Safety Valve with Split Ball" and to U.S. Pat. No. 3,830,297, granted Aug. 20, 1974 for "Subsurface Safety Valve with Improved Balancing Valve Means". These automatic subsurface shutoff valves of the ball type are relatively easy to manipulate from the closed to the opened position, notwithstanding high well fluid pressure tending to hold the shutoff valve closed. More particularly, a control fluid operated by-pass or equalizing valve is incorporated in the shutoff valve assembly so that as control fluid pressure is being supplied to open the shutoff valve the pressure differential across the shutoff valve is first equalized, and then the shutoff valve is shifted to an open position.

These prior patents illustrate subsurface safety valves wherein the control fluid pressure utilized to open the shutoff valve first acts either (U.S. Pat. No. 3,971,438) on a one-piece annular piston to overcome the differential pressure holding the shutoff valve closed to open the by-pass or equalizing valve means incorporated in the ball type shutoff valve, or (U.S. Pat. No. 3,830,297) on an equalizing valve actuating portion of a two piece piston to equalize the pressure across the shutoff valve. However, the piston area of the valve actuating pistons on which control fluid pressure can act is quite limited, and such area limitations are even a greater problem in the smaller sizes of shutoff valve assemblies. Indeed, small amounts of corrosion may cause such additional friction as to render the valve inoperative.

Another problem encountered in ball type shutoff valve assemblies of the type here involved is that when such valves have a sealing sleeve which makes metal to metal sealing contact with the ball, high friction may result from high pressure differential across the closed ball valve tending to interfere with opening of the valve.

Other valve assemblies, such as pilot valves, and valve actuators, such as gate valve actuators, also have need for a valve means which is easy to operate either for minimizing erratic pressure response or for relieving pressure differentials, but the typical valve of such types either is difficult to operate or tends to leak.

The present invention provides an improved subsurface, automatic shutoff valve for wells, wherein the equalizing or by-pass valve which is first opened, to equalize pressure differential across the closed main shutoff valve, before the main shutoff valve is opened, is easy to operate but yet simple and positive in its closing.

The present invention also provides an improved subsurface, automatic shutoff valve for wells, wherein frictional engagement between the ball valve and the metal sealing sleeve is eliminated upon equalization of the pressure differential across the closed ball valve.

Further, the invention provides a simple, effective valve sub-assembly for use in shutoff or other valves wherein positive sealing and ease of operation are important.

More particularly, the present invention provides an automatic, control fluid pressure responsive, subsurface shutoff valve, wherein the actuator piston means which is adapted to open the shutoff valve has a relatively large control fluid pressure responsive area, for a given valve assembly size, and incorporates an equalizing or by-pass valve port which is closed by valve means which are easily opened, without requiring high operating pressure. The actuator piston means also employs the same effective control fluid pressure responsive area to open the shutoff valve, after the differential pressure across the shutoff valve has been equalized.

In accomplishing the foregoing, a novel valve assembly is incorporated in the subsurface shutoff valve assembly. In this connection, the tubular outer housing has an internal groove defined between opposed circumferential, axially spaced shoulders, the groove containing a ball or a plurality of balls loosely disposed in the groove for free motion therein and confined by a cylindrical outer surface of the actuator piston for the shutoff valve. This actuator piston has one or more by-pass ports in communication with the well tubing above the shutoff valve, and the housing has another by-pass port or ports in communication with the well bore below the valve and with the groove containing the balls. When the piston port or ports confront the groove containing the balls, fluid from below the shutoff valve tending to flow through the housing port or ports, into the groove containing the balls and then through the piston port or ports, will cause a ball to seat in the piston port or ports and form a complete seal.

However, when the piston is longitudinally shifted relative to the housing the seated ball is carried into engagement with one of the shoulders forming the groove containing the balls, and the shoulder wipes the ball from the piston port, allowing communication between the piston and housing ports, via the groove. The flow of fluid through the piston ports, during the equalization of pressure, in the case of the shutoff valve application, effects a cleaning action, so that the ball seat formed by the port and the balls are subsequently capable of a tight leak-proof seal.

When the shutoff valve is open to allow flow from the well through the valve assembly, well fluid flow through the by-pass port in the piston is prevented by side ring seals between the piston and the housing disposed in axially spaced relation and straddling the piston port.

The actuator piston also acts upon a ball type shutoff valve, according to one embodiment, through a second piston or sealing sleeve which actuates the ball shutoff valve between its open and closed position. The ball shutoff valve is supported for rotation on elongated control bars which will resiliently buckle longitudinally when the shutoff valve is closed, so that the spherical ball surface is forced into engagement with the end of the sealing sleeve, thereby closing any predetermined gap therebetween so that a resilient sealing ring, exposed to well pressure cannot be extruded between the ball and the actuator sleeve. However, the arrangement is such that upon equalization of the pressure differential across the shutoff valve, as referred to above, the control bars return to their extended condition, eliminating contact between the second piston or valve actuating sleeve and the ball surface to further reduce frictional resistance to opening of the shutoff valve, thereby further minimizing the total pressure necessary to open a given size shutoff valve.

The equalizing or by-pass valve referred to above is a simple, yet effective valve which can be availed of in other fluid flow control operations wherein ported members are relatively shifted, such as in pilot valve controls, or other valve installations where ease of actuation or control is necessary or desired.

This invention possesses many other advantages, and has other objects which may be made more clearly apparent from a consideration of several forms in which it may be embodied. Such forms are shown in the drawings accompanying and forming part of the present specification. These forms will now be described in detail for the purposes of illustrating the general principles of the invention; but it is to be understood that such detailed description is not to be taken in a limiting sense.

Referring to the drawings:

FIGS. 1*a*, 1*b*, 1*c*, and 1*d* together constitute a longitudinal quarter section showing one form of automatic shutoff valve embodying the invention, with the shutoff valve and the equalizing valve both in the closed condition, FIGS. 1*b* thrugh 1*d*, respectively, constituting successive downward continuations of FIG. 1*a;*

FIGS. 2*a* and 2*b* together constitute a fragmentary longitudinal section of the portions of the valve assembly of FIGS. 1*a* through 1*d* containing the shutoff valve and the equalizing valve, and showing the equalizing valve in the open condition and the shutoff valve in a condition just prior to the opening thereof, FIG. 2*b* being a downward continuation of FIG. 2*a;*

FIGS. 3*a*, 3*b*, and 3*c* together constitute a fragmentary longitudinal section showing the shutoff valve in the open condition and the equalizing valve in a second closed condition preventing reverse flow, FIGS. 3*b* and 3*c* constituting successive downward continuations of FIG. 3*a;*

Figure 10A:
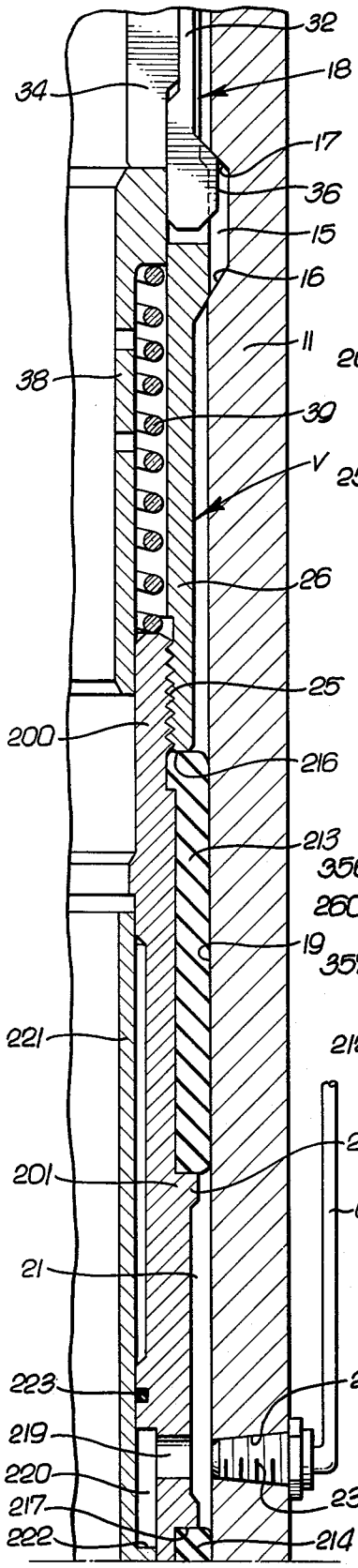
Figure 10B:
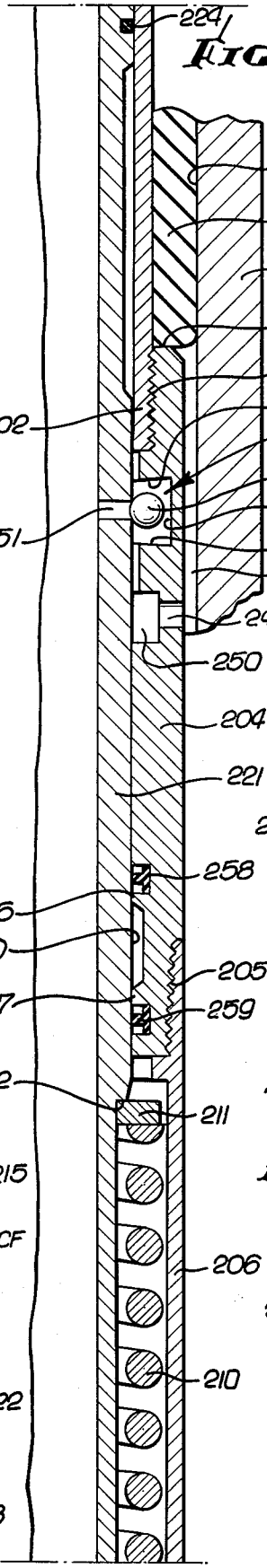
Figure 10C:
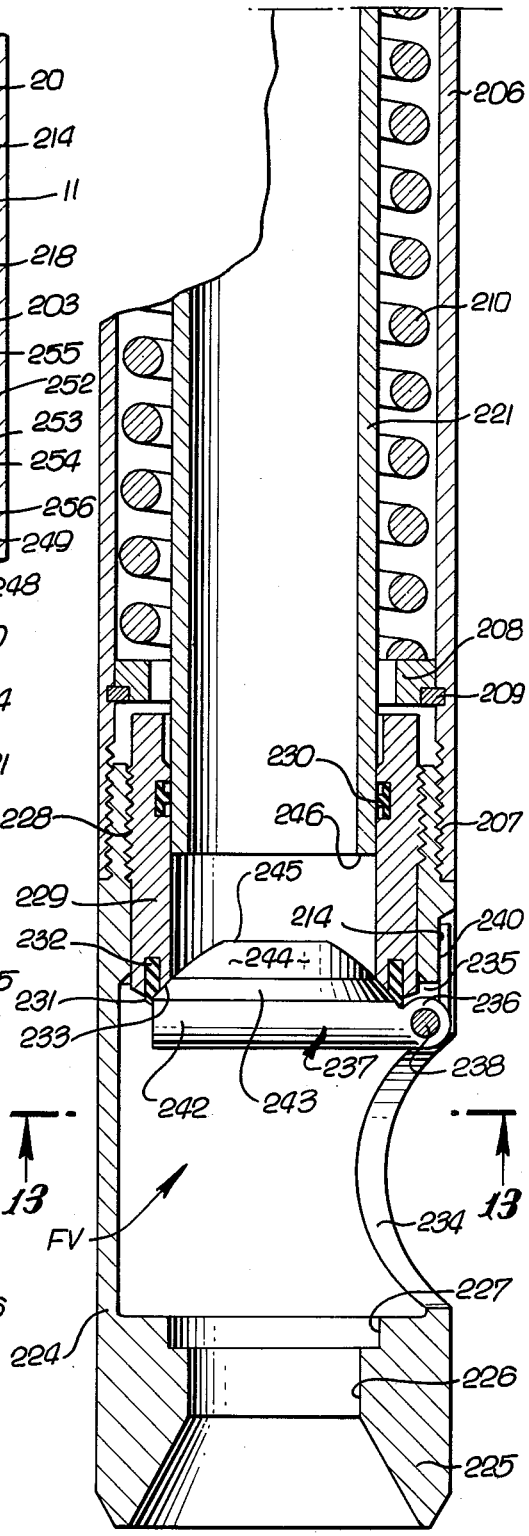

FIGS. 10*a*, 10*b*, and 10*c* together constitute a longitudinal quarter section illustrating another form of automatic shutoff valve embodying the invention, with the shutoff valve in the closed condition and with the equalizing valve in the closed condition, FIGS. 10*b* and 10*c* constituting successive downward continuations of FIG. 10*a;*

Figure 11A:
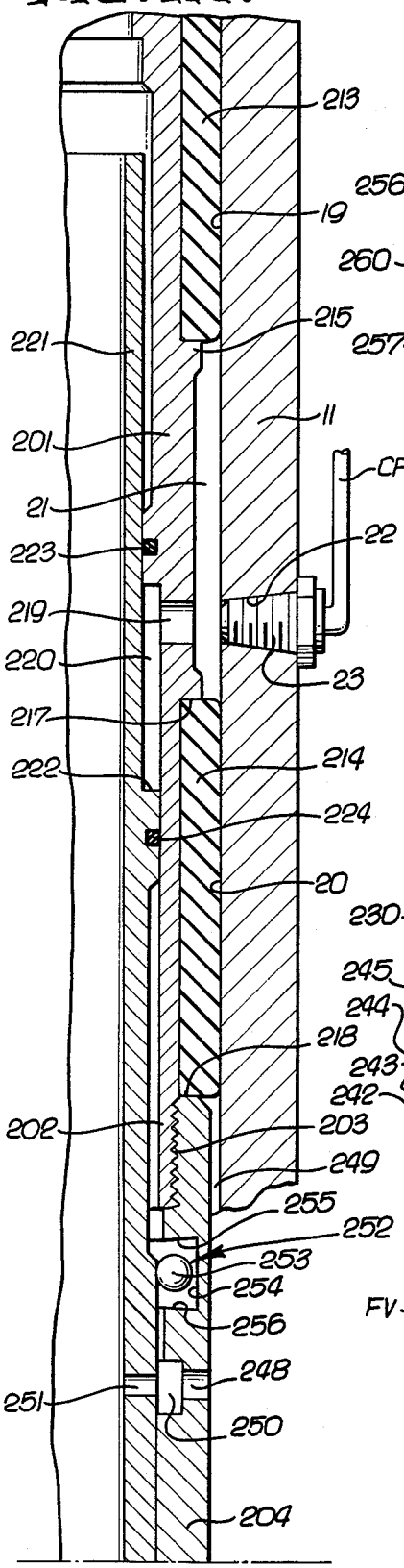
Figure 11B:
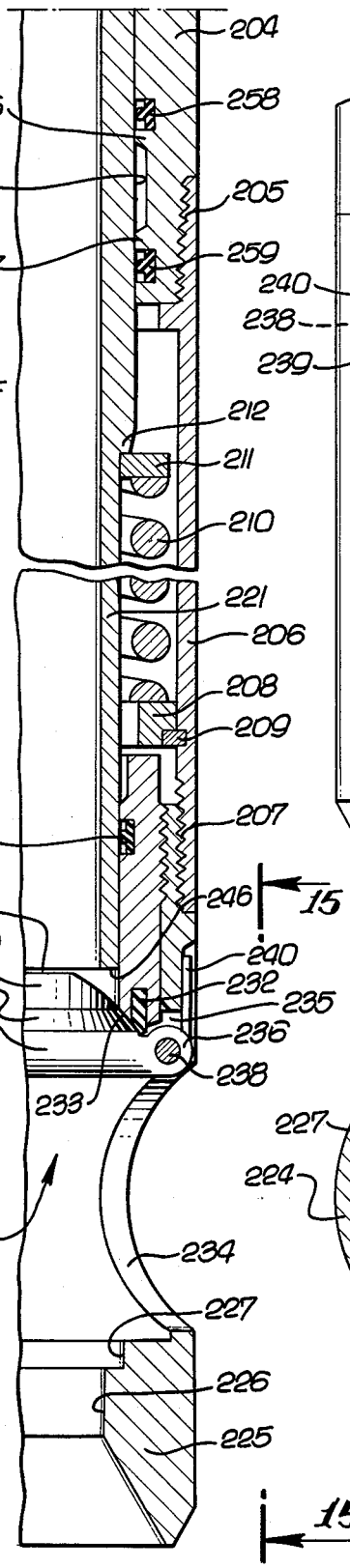

FIGS. 11*a* and 11*b* together constitute a fragmentary longitudinal section of the portions of the valve assembly of FIGS. 10*a* through 10*c* containing the shutoff valve and the equalizing valve, and showing the actuator sleeve just prior to opening of the main shutoff valve and showing the equalizing valve in the open condition, FIG. 11*b* being a downward continuation of FIG. 11*a;*

Figure 12A:
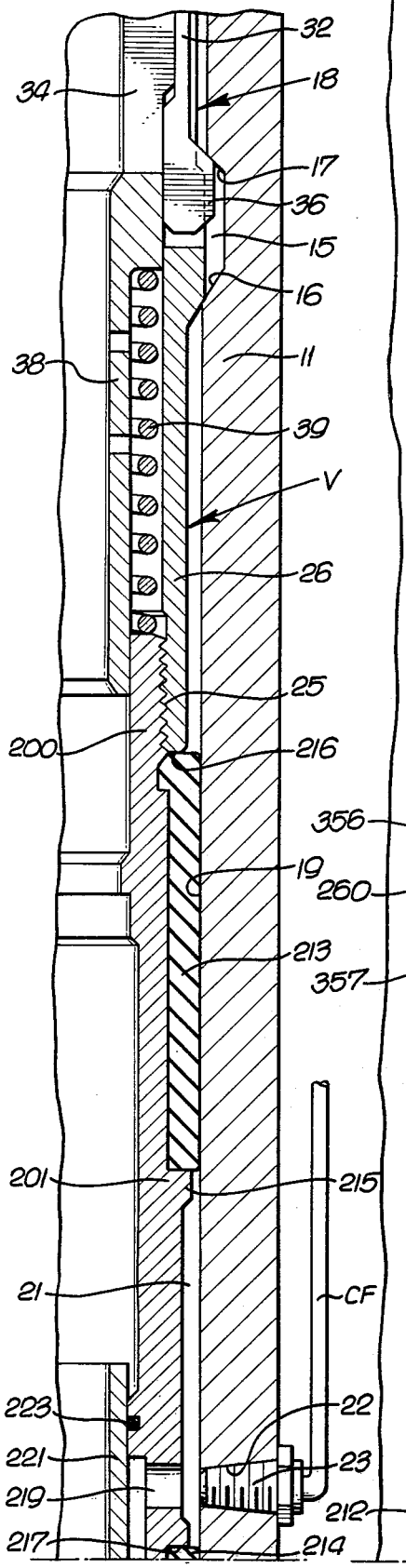
Figure 12B:
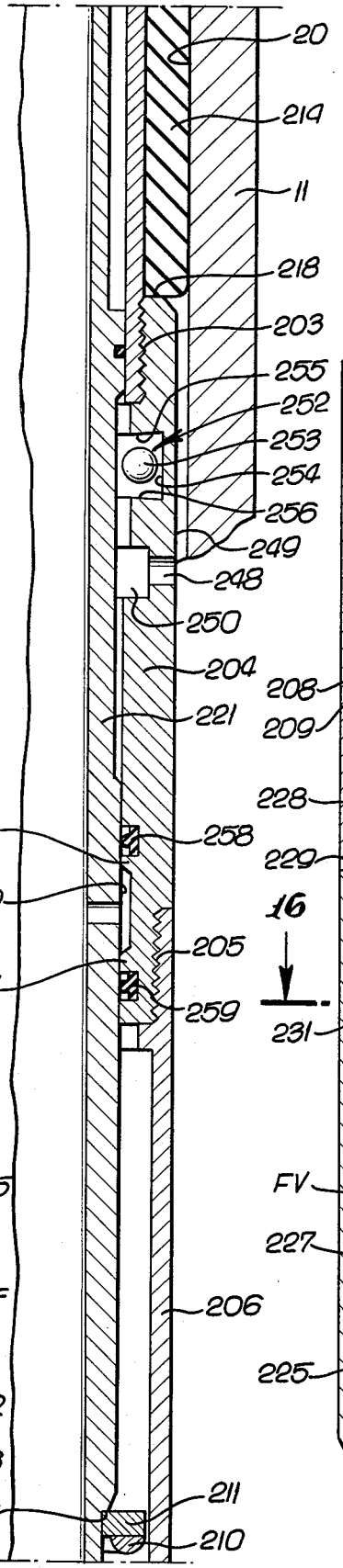
Figure 12C:
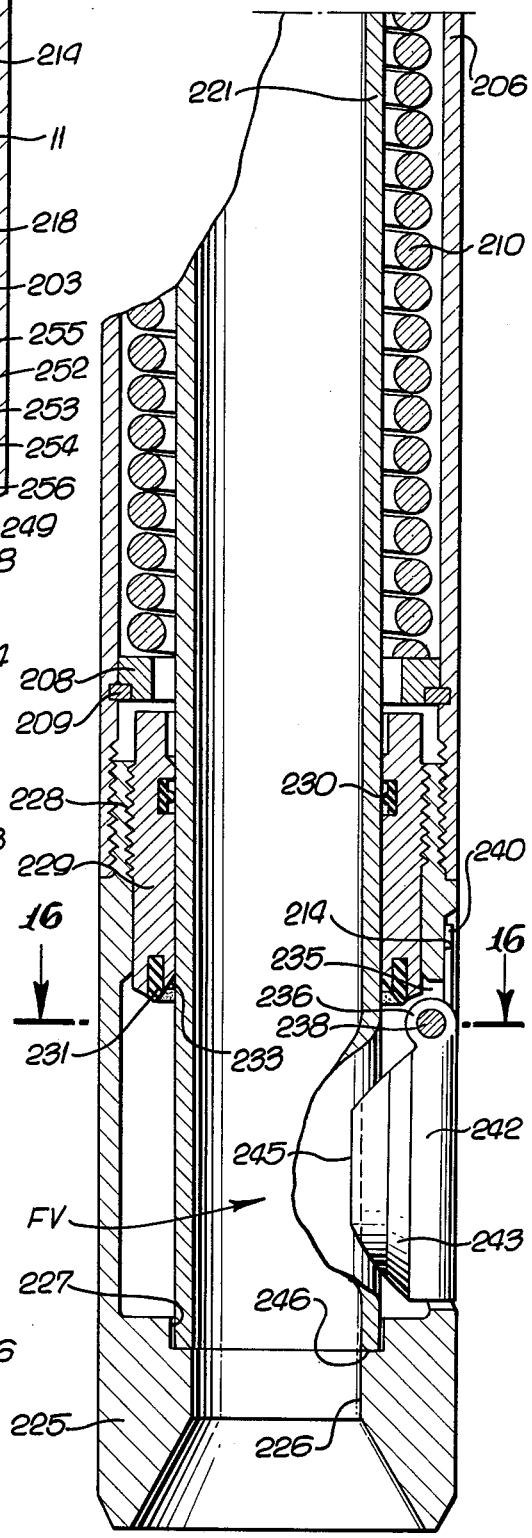

FIGS. 12*a*, 12*b*, and 12*c* together constitute a longitudinal quarter section showing the valve of FIGS. 10*a* through 10*c* in the open condition and showing the by-pass valve closed against the reverse flow, FIGS. 12*b* and 12*c* constituting successive downward continuations of FIG. 12*a;*

Figure 13:
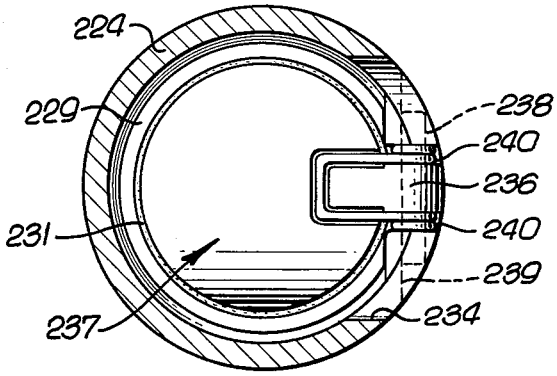
Figure 6:
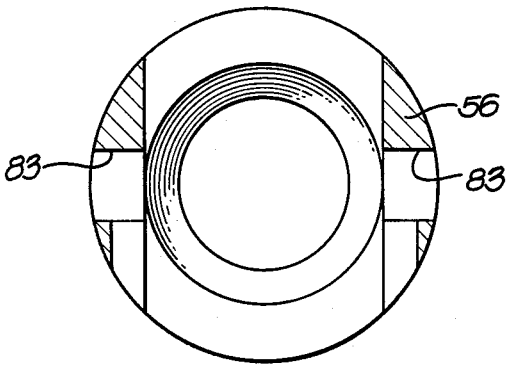
FIG. 6 is a transverse section as taken on the line 6—6 of FIG. 2*b;*

FIG. 13 is a horizontal section as taken on the line 13—13 of FIG. 10*c;*

Figure 14:
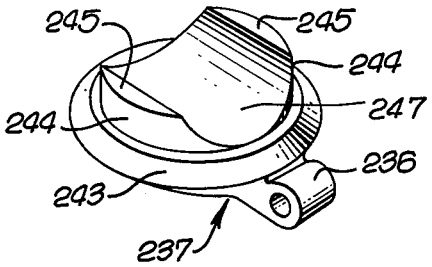

FIG. 14 is a detailed view in perspective illustrating the flap valve of the valve assembly of FIGS. 10*a* through 10*c;*

Figure 15:
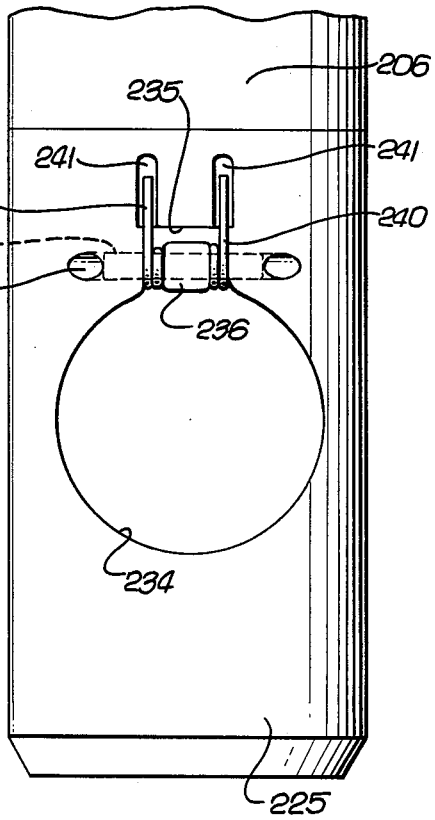

FIG. 15 is fragmentary side elevation of the portion of the valve assembly defined by the line 15—15 of FIG. 11*b;*

Figure 16:
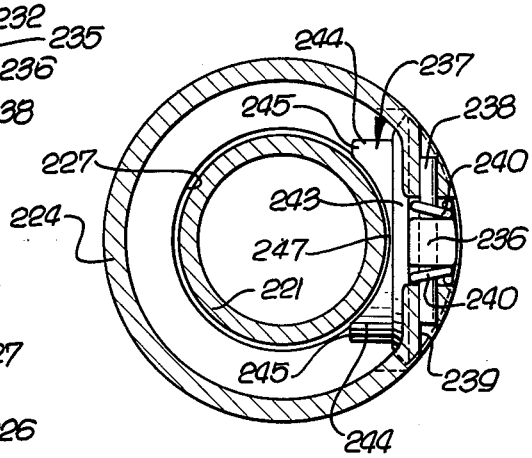

FIG. 16 is a transverse section as taken on the line 16—16 of FIG. 12*c* through the flap valve sub-assembly.

As is well known, and as illustrated in the above-identified prior United States patents, automatic shutoff valve assemblies of the type herein disclosed are adapted to be installed in a string of well production tubing which extends downwardly through a well casing set in a well bore, the tubing having a landing nipple for receiving a valve assembly which is retrievably seated therein by wireline tools, as will be later described. Typically, the tubing T and casing C extend upwardly through a body of water to a platform, such as a production platform, either beneath the surface of the water or on the surface of the water and having typical well control apparatus and flow lines for conducting well fluid to a suitably located reservoir. A well packer is set in the casing and forms a lower seal between the tubing and the casing below the shutoff valve assembly.

Figure 1D:
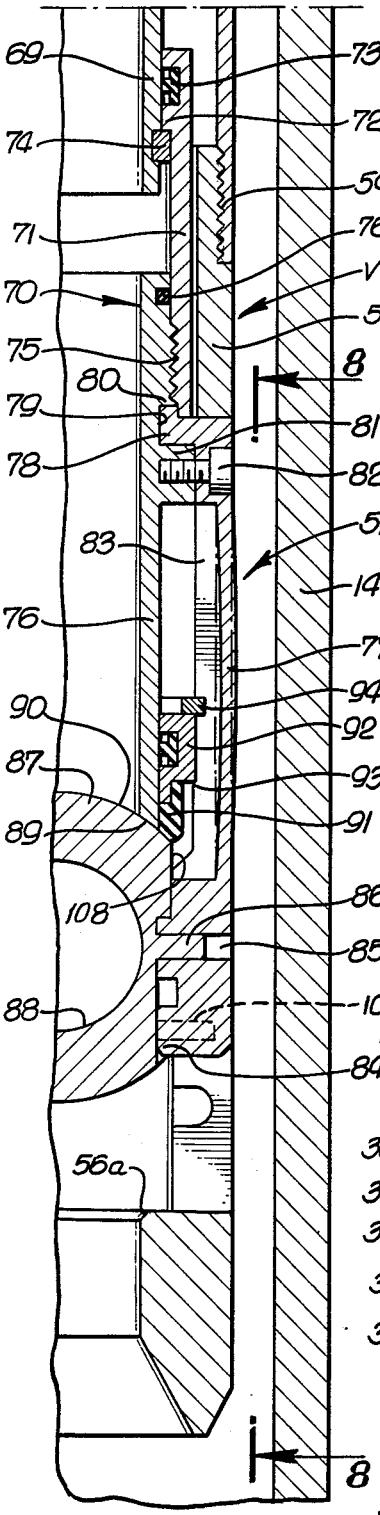
Figure 1A:
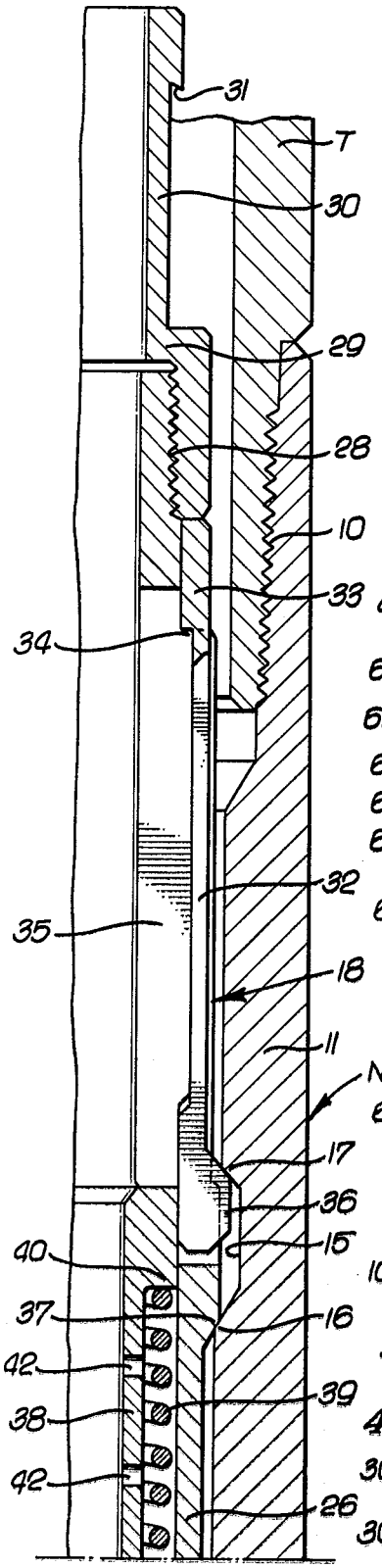

As seen in the drawings of this application, referring to FIGS. 1*a* to 9, the tubing string T is shown as being threadedly connected at 10 into the upper end of an elongated tubular body 11 constituting the landing nipple N for the sub-surface shutoff valve assembly V. At its lower end 12 the landing nipple body 11 is threadedly connected at 13 to a downwardly extended elongated tubular body or member 14 which may be of any desired length, say several or thousands of feet in length, and which is disposed between the landing nipple body 11 and the previously referred to packer (not shown). As seen in FIG. 1*a* such a landing nipple typically is provided with an internal groove 15 between an upwardly facing seat or shoulder 16 and a downwardly facing shoulder 17. The valve assembly V lands upon the shoulder 16, and latch means 18 engage the downwardly facing shoulder 17 to retain the valve assembly against upward displacement.

Below the groove 15, the landing nipple body 11 has an upper cylindrical sealing bore 19 and a downwardly spaced cylindrical sealing bore 20, between which bores is an elongated space 21. The nipple body 11 has a port 22 extending radially into the space 21, and a connector fitting 23 connects the control fluid tubing CF which extends downwardly from a suitable pressure source in the tubing-casing annulus to the landing nipple 11, whereby, as will be later described, when the safety valve assembly V is seated and latched in the landing nipple N, control fluid is applicable to the safety valve V to actuate the same.

The valve assembly V is an elongated assembly adapted to be run into the landing nipple N and retrieved by means of a wireline tool, as is well known. An elongated tubular valve body assembly 24 has an upper threaded neck 27 on which an upwardly extended tubular latch body 26 is threadedly connected at 25 the latch body 26 being connected at 28, at its upper end, to a running and retrieving head 29. The head 29 has a neck 30 providing a downwardly facing shoulder 31 for engagement by a wireline running tool or a wireline retrieving tool (not shown).

The latch means 18 comprises a plurality of collet or latch fingers 32 depending from a supporting ring 33 which seats on a shoulder 34 of the body 26 and is retained in place by the head 29. The body 26 has elongated slots 35 which enable the fingers 32 to be flexed inwardly. At the lower ends of the latch fingers 32 are outwardly projecting latch lugs 36 adapted to project into the groove 15 of the landing nipple body 11 for engagement beneath the shoulder 17 for retaining the valve assembly V in the nipple body 11, with a downwardly facing shoulder 37 on the body 26 supporting the valve assembly on the shoulder 16 of the nipple body 11. A retainer sleeve 38 is reciprocably disposed in the body 26 and is biased upwardly by a coiled spring 39 disposed between a head flange 40 of the sleeve 38 and the upper end 27 of the valve assembly. The body 26 and the sleeve 38 have openings 41 and 42, respectively, to prevent fluid entrapment or bias. As is well known, a running tool is engageable with the neck 30 and is operable to hold the retainer sleeve 38 in a lower position (not shown) enabling the collet fingers to flex inwardly as the assembly lands in the nipple body 11, and when the running tool is removed, the sleeve 38 is forced upwardly by the spring 39 to hold the fingers 32 outwardly, as shown in the latching position of FIG. 1*a*.

The valve assembly V comprises an elongated tubular body structure including an upper tubular seal mandrel or body section 43 having the neck 27 thereon. This mandrel 43 has upper and lower side sealing ring means or packings 44 and 45 engaged in the nipple body 11. When the valve assembly V is seated in the landing nipple 11 the packings 44 and 45 straddle the contol fluid inlet 23 in the space 21 defined between the valve assembly and the landing nipple body 11.

The packing 44 is disposed between the lower end shoulder 46 provided at the lower end of the latch body 26 and an upwardly facing shoulder 47 on the tubular valve body section 43. The valve body section 43 also has a downwardly facing external shoulder 48 against which the lower packing 45 is adjustably positioned by an upper end shoulder 49 provided by a tubular equalizing valve housing or body 50 which is threadedly connected at 51 to the lower end of the sealing mandrel 43 and constitutes a downward extension of the tubular valve body assembly. The lower end 52 of the equalizing valve housing 50 is threadedly connected at 53 to a downwardly extending tubular member 54, constituting a spring housing and a further downward extension of the tubular valve body assembly. At its lower end, the spring housing 54 is threadedly connected at 54' to a cage member 56, which will hereinafter be described in more detail and which contains the shutoff valve subassembly generally denoted at 57.

Within the spring housing 54 is a coiled compression spring 55 which seats at its lower end on a ring 55' which abuts with a stop ring 55" provided within the spring housing 54. At its upper end the spring 55 engages a spring seat 58 which in turn engages with a shoulder 59 provided externally on an elongated tubular piston or actuating sleeve 60 which is longitudinally shiftably mounted within the elongated valve body assembly previously described, and normally biased upwardly by the coiled spring 55.

The piston or actuator sleeve 60 has its upper end reciprocably disposed within the tubular valve body section or sealing mandrel 43, the latter having an internal O-ring or side ring seal 61 slidably and sealingly engaged with the reduced diameter upper end section 62 of the piston sleeve 60. Below the sealing ring 61, the piston or actuator sleeve 60 has an annular piston flange or section 63 slidably disposed within an enlarged bore 64 defined within the seal mandrel 43, and carrying a side ring seal or O-ring 65 slidably engaged within the bore 64. Between the sealing rings 61 and 65 the seal mandrel 43 has a suitable number of ports 66 extending radially and communicating with the space 21 in the landing nipple body 11 between the upper and lower packings 44 and 45, whereby control fluid supplied through the inlet 23 to the space 21 can be communicated to the annular piston chamber or cylinder 67 defined between the piston 63 and the downwardly facing shoulder 68 on the sealing mandrel 43. The annular area of the chamber 67 effectively defines the annular piston area of the piston 63 which is exposed to control fluid pressure to effect downward movement of the piston or actuator sleeve 60, against the upward bias of the spring 55, to effect opening of the shutoff valve, as will be later described.

At its lower end 69, as seen in FIG. 1*d*, the piston or actuator sleeve 60 supports a lower or retractable piston sub-assembly 70. This sub-assembly 70 includes a connector sleeve 71 having at its upper end 72 a sealing section provided with a side ring seal 73 slidably and axially shiftably disposed about the lower end 69 of the piston 60, and limited against displacement from the lower end of the piston sleeve 60 and retractable by a suitable stop collar 74 carried by the lower end 69 of the piston sleeve 60. At its lower end, the connector sleeve 71 is threadedly connected at 75 to the upper end of a lower piston sleeve or sealing sleeve 76, a suitable sealing ring 76' being disposed between the lower piston sleeve 76 and the connector sleeve 71.

This lower piston or sealing sleeve 76 has a pair of diametrically disposed longitudinally extended control bars 77 mounted thereon at the upper ends of the control bars. The control bars 77 have lugs 78 at their upper ends confined within a groove 79 formed in the sleeve 76 between a downwardly facing shoulder 80 and an outstanding projection 81 on the lower piston sleeve 76, upon threaded engagement between the connector sleeve 71 and the piston sleeve 76. Cap screws 82 are also threaded through the upper ends of the control bars 77 and into the bosses or lugs 81 on the piston sleeve 76. These control bars 77 are vertically reciprocable in diametrically opposed slots 83 which extend longitudinally in the supporting cage 56 previously referred to, and at the lower ends of the control bars 77 are inwardly projecting bosses 84 having aligned bores 85 therein rotatably receiving the diametrically opposed trunnions 86 of a ball valve 87, whereby the ball valve is adapted to rotate about the axis of the trunnions 86 so as to be in a closed position with a central bore 88 through the ball 87 disposed transverse to the valve assembly, or in the open position with the ball bore 88 disposed in alignment with the valve assembly.

When the ball valve 87 is disposed with the bore 88 transverse to the valve assembly, as seen in FIG. 1*d*, the shutoff valve is closed, and the lower spherical end 89 of the lower piston sleeve or sealing sleeve 76 is adapted to conform with the spherical outer ball surface 90, but normally in slightly spaced relation thereto providing a small gap so that there is no friction between these parts. This gap is adapted to be closed by means of an elastomeric seal ring 91 supported beneath a carrier ring 92 which is carried by the cage 56 between an upwardly facing shoulder 93 and a suitable retainer ring 94.

As seen in FIGS. 1*a* through 1*d* the shutoff valve assembly is in a closed condition. As illustrated in an exaggerated manner in FIG. 1*d*, it will be noted that the lower spherical end 89 of the lower piston or sealing sleeve 76 is in engagement with the spherical ball surface 90, so that there is no possibility for the elastomeric sealing ring 91 to extrude between the engaged sealing sleeve and ball. However, the length of the control bars 77 is selected such that, initially, upon closure of the ball valve 87, a small gap existed between the confronting spherical faces 89 and 90 of the sealing sleeve and the ball, but responsive to increased well pressure below the shutoff valve 87 acting to shift the shutoff valve ball and actuator means upwardly with respect to the housing assembly 24, and due to the anchoring of the sealing sleeve 76 against such upward movement by engagement of the control bar support lugs 78 with the upper ends 95 of the cage slots 83, the sealing sleeve 76 cannot move upwardly. As pressure below the ball valve 87 increases the control bars 77 will be longitudinally deformed or caused to buckle slightly, from the broken line condition of FIG. 1*d* to the full line condition, so that the spherical ball surface 90 actually abuts with the lower spherical end surface 89 of the sealing sleeve 76. Thus, the control bars 77 are of reduced thickness between their ends and resiliently deformable to permit this function, and, as a result, the resilient seal ring 91 cannot be caused by high pressure differential to be extruded between the ball and sealing sleeve.

When the ball valve is closed, as just described, it is desired that the fluid pressure across the ball valve be equalized before opening of the ball valve commences, so as to minimize resistance to actuation of the valve to the open condition. In accordance with the present invention, as will now be described, the equalization of fluid pressure across the shutoff valve is accomplished during an initial increment of movement of the actuator piston sleeve in a downward direction in response to the application of control fluid pressure to the control fluid pressure chamber 67.

Figure 2A:
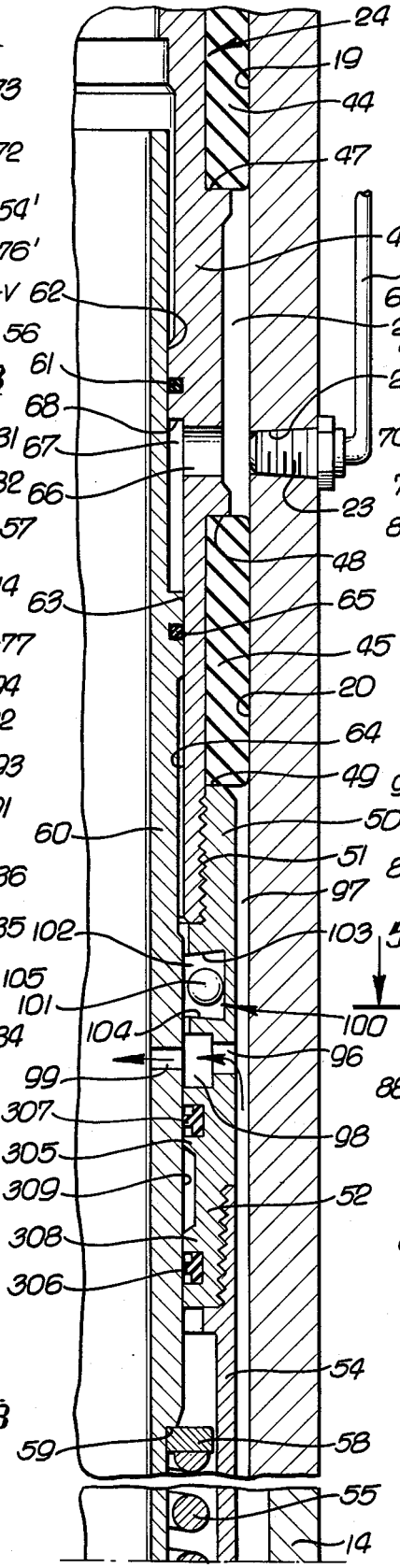
Figure 1B:
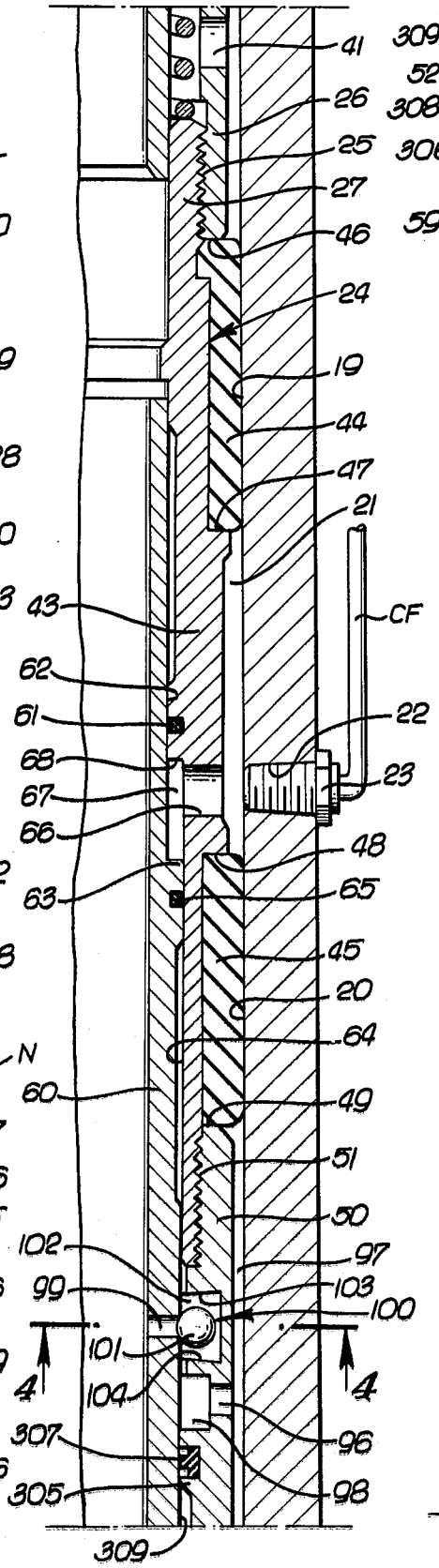
Figure 1C:
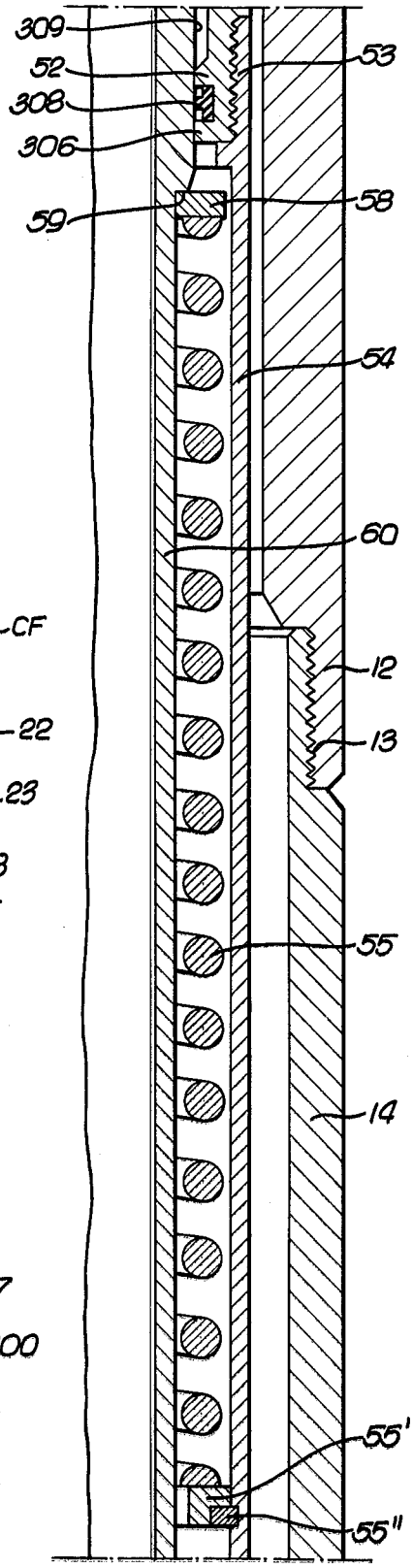

As previously indicated, the tubular valve body assembly 24 comprises, as one of its tubular components, the equalizing valve housing 50 previously referred to. The equalizing valve housing 50 has between its ends one or a number of circumferentially spaced radial ports 96 which lead from the annular space 97 between the landing nipple body 11 and the equalizing valve housing 50, below the lower packing 45, so that the port or ports 96 are exposed to the pressure of fluid in the well. An annular groove 98 within the housing 50 establishes communication between the ports 96. The actuator piston sleeve 60 has a number of by-pass or equalization ports 99 formed in circumferentially spaced relation and extending radially therethrough and adapted, depending upon the longitudinal position of the actuator sleeve or piston 60 to be either closed by ball means 100 as seen in FIG. 1*b* or to be in communication with the housing ports 96 as shown in FIG. 2*a*.

Ball means 100 comprises a plurality of suitable spherical beads or balls, say, of metal, plastic, glass, or other material capable of withstanding the substantial differential pressure between the fluid in the well below the ball valve 87 and the fluid in the piston sleeve 60. The balls or beads 101 are confined between the piston sleeve 60 and the equalizing valve housing 50 in a groove 102 which extends circumferentially of the housing 50 and is defined between an upper annular shoulder 103 and a lower annular shoulder 104 provided by the housing 50. The lower shoulder 104 is formed on an angle sloping downwardly and outwardly. These balls 101 are loosely disposed within the groove 102 so as to be relatively free for movement circumferentially and axially of the groove, and fluid entering through the housing ports 96 and passing into the ball containing groove 102 and then through the piston ports 99 will carry one of the balls into seating engagement against the piston sleeve at each of the port or ports 99, causing an effective seal for preventing communication of fluid from below the closed ball valve 87 into the piston sleeve 60. However, when the piston sleeve 60 is moved downwardly for the purpose of initiating opening of the ball valve 87, the seated balls or beads 101 will be brushed from the piston ports 99 upon contact with the upwardly facing shoulder 104. The slope of the shoulder 104 assists in causing the removal of the balls 101 from the ports 99 in that the shoulder has a positive slope. Moreover, the flow of fluid through the equalizing ports 96 and 99 as well as through the ball containing groove 102 during equalization of the pressure across the shutoff valve performs a cleansing action whereby the balls and the ball seats provided by the piston sleeve will at all times be clean so that an effective closure can be accomplished.

Figure 3A:
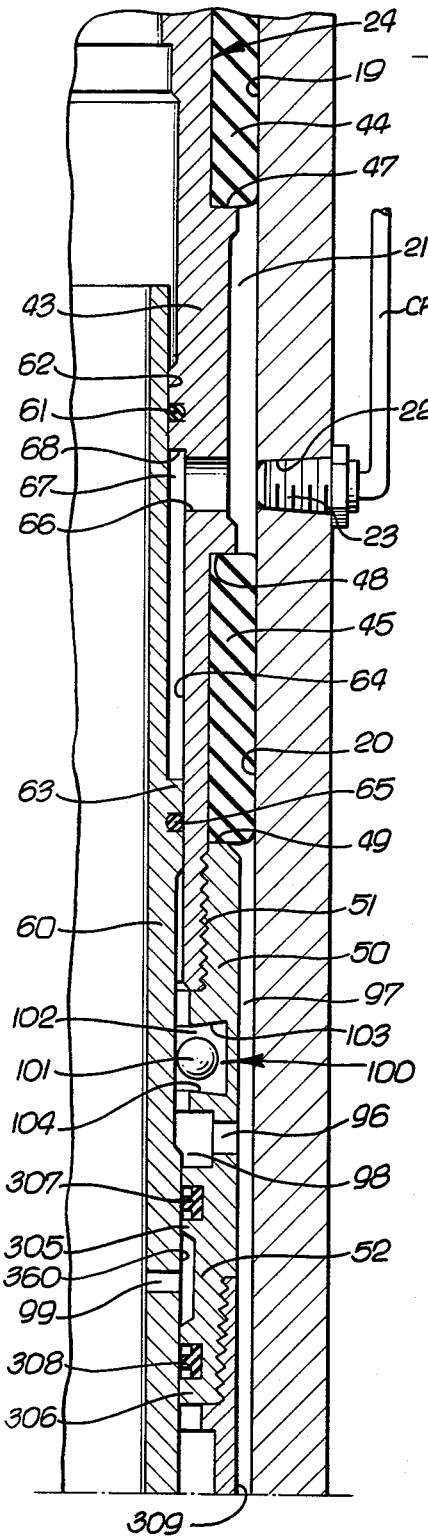
Figure 3B:
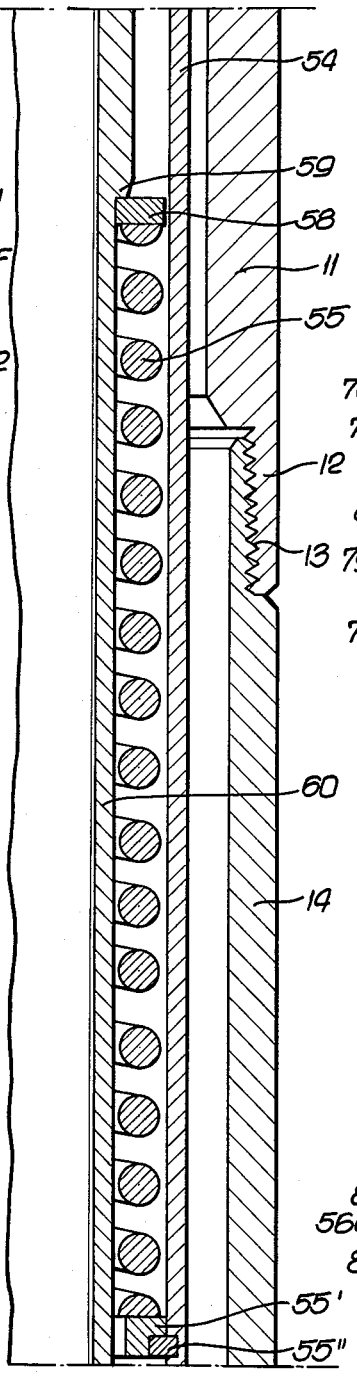

When the shutoff valve assembly is in the open condition of FIGS. 3*a* through 3*c*, as will be later described, it is desired that no fluid pass through the equalizing ports 96 in the housing 50 and 99 in the piston sleeve 60 in any direction. Accordingly, the piston sleeve 50 is provided below the equalizing ports 96 with a pair of axially spaced sealing portions 305 and 306 respectively carrying side ring seals 307 and 308 slidably and sealingly engaged with a cylindrical section 360 of the piston sleeve 60, these seal rings 307 and 308 straddling the piston ports 99 when the piston 60 is in its lowermost position, as seen in FIG. 3*a*.

Figure 8:
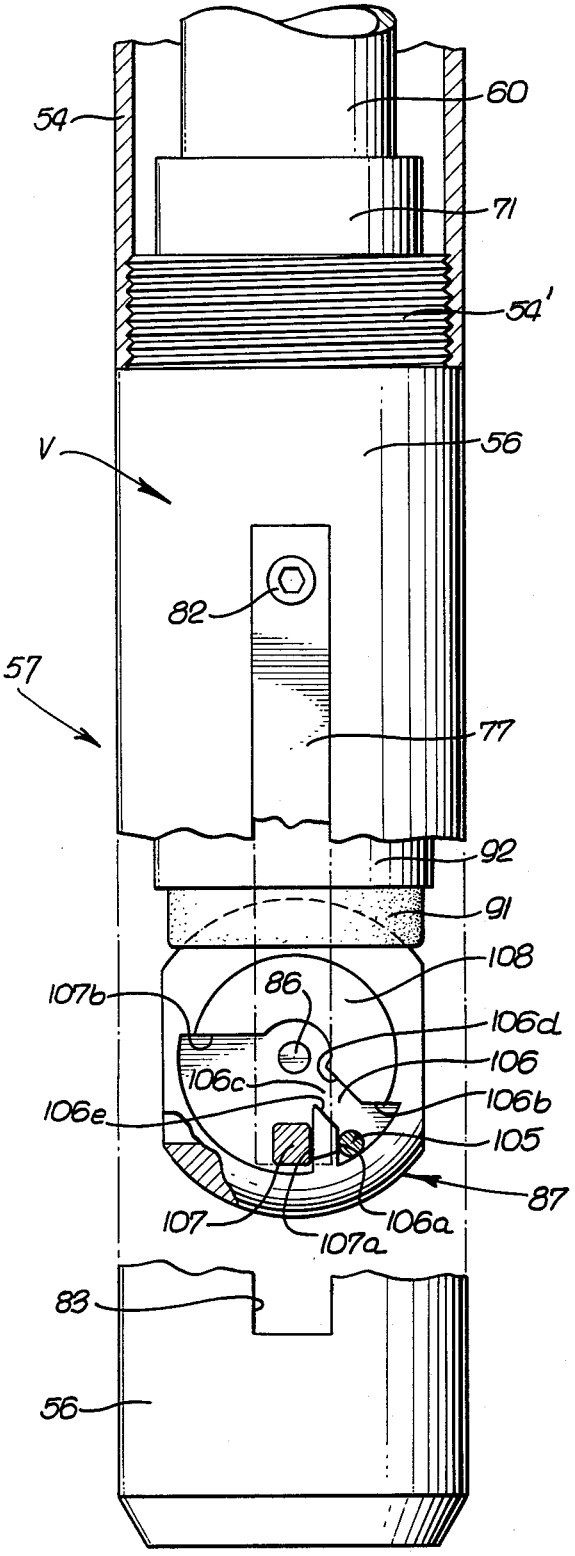
FIG. 8 is a fragmentary view partly in elevation, with parts broken away, illustrating the main ball valve in the closed condition.
Figure 9:
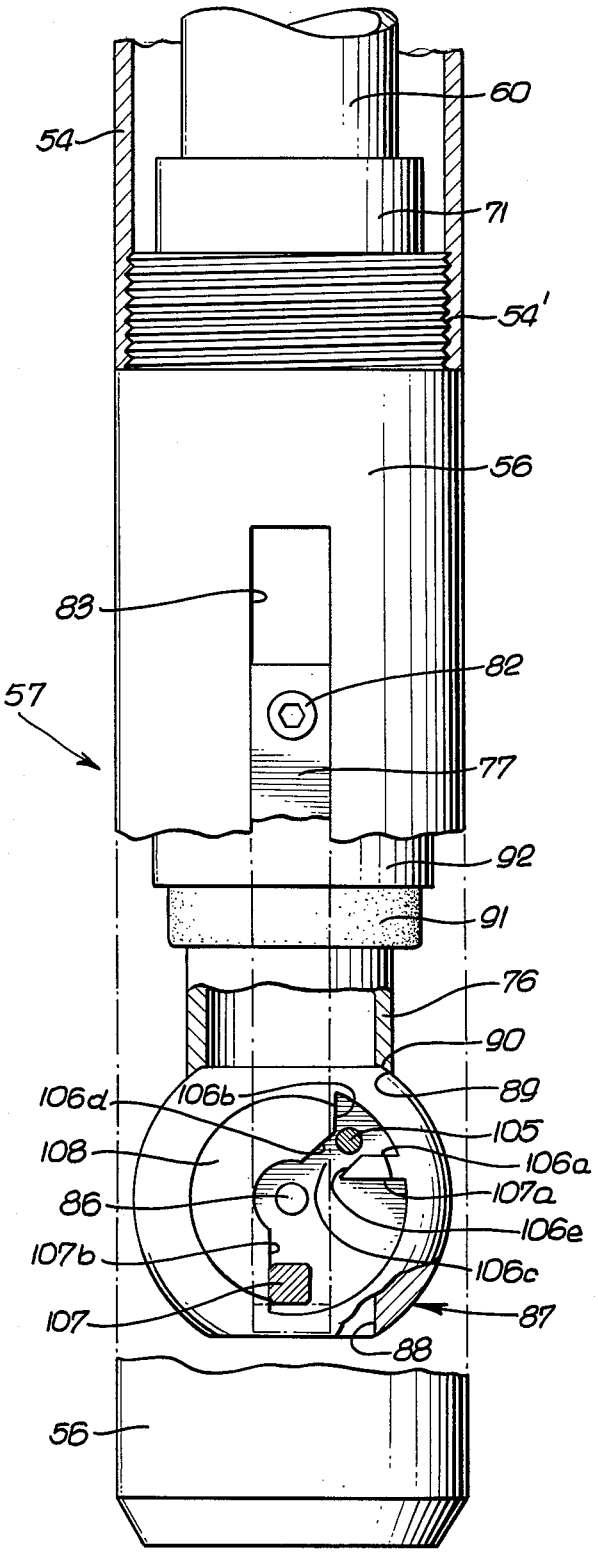
FIG. 9 is a view corresponding to FIG. 8, but showing the ball valve in the open condition.

As previously indicated, downward movement of the piston sleeve 60 under the influence of control fluid pressure applied to the piston chamber 67, is adapted to cause engagement of the lower end of the piston sleeve 60 with the lower piston or sealing sleeve 76 which carries the control bars 77 which in turn support the ball valve 87 on the trunnions 86. Such downward movement of these components is adapted to cause the ball valve 87 to assume the open position, with the passage therethrough aligned with the valve assembly. On the other hand, upward movement of the lower piston or sealing sleeve 76 and the control bars 77 under the influence of well fluid pressure below the valve assembly, and in response to the application of an upward pull to the connector sleeve 71 by the piston sleeve 60, under the influence of the return spring 55, will cause the ball to be moved to the closed position with the passage therethrough extending transversely of the valve assembly. These two positions are shown in FIGS. 8 and 9, wherein the means for effecting such closing and opening movements of the ball valve 87 will be seen to comprise pin 105 and slot 106 means cooperable between the ball 87 and the ball supporting bosses 84 on the control bars 77. Further, the position of the ball valve 87 is established by a stop lug 107 also carried by the control bars 77, as will all now be described.

The relationship of the ball valve actuating pin 105 and the slot 106 is best seen in FIGS. 8 and 9, it being understood that the ball valve 87 may have identical slots 106 at its opposite sides engaged by diametrically opposite pins 105. More particularly, the ball valve 87, on each of its opposite sides, has a chordal flat surface 108 adjacent to the diametrically opposite bars or arms 77 of the ball support means. The slot 106 extends radially with respect to the axis of rotation of the ball valve 87. The ball 87 also provides a pair of right angularly related stop surfaces 107*a* and 107*b*. When the ball valve member is in the position of FIG. 8, the stop surface 107*a* engages one vertical side wall of the adjacent stop lug 107 on support arm 77, thereby limiting rotation of the valve member to the position at which the valve is closed. The stop surface 107*b* on the ball 87 engages the lug 107, as shown in FIG. 9, to limit rotation of the valve member to the position at which the valve is open. Such rotation between the closed and open positions is caused by longitudinal or vertical movement of the valve 87, the two longitudinal extremes being shown in FIGS. 8 and 9.

The slot 106 is formed in such a manner as to cause such rotation of the valve member as the latter moves vertically or longitudinally. Thus, as seen in FIGS. 8 and 9, the mouth of the slot 106 is formed in the valve 87 by opposed walls which are disposed at a right angle to one another and designated 106*a* and 106*b*, and which, respectively, are parallel to the stop surfaces 107 and 107*b*. At the apex of the angle defined between the walls 106*b*, the slot 106 opens inwardly at 106*c* and has walls 106*d* and 106*e*. The relationship between the pin 105 and the walls 106*b* and 106*d* is such that some longitudinal downward movement of the ball valve will occur without rotation of the ball valve, but when the pin 105 engages wall 106*d*, it will be rotated until the pin 105 clears wall 106*d* and stop surface 107*b* engages the stop lug 107. Thereafter, downward movement of the ball valve will occur without rotation. Conversely, if the ball valve is in the position of FIG. 9, some longitudinal upward movement of the ball valve will occur before the pin 105 engages the wall 106*e*. Continued upward movement will rotate the ball valve until stop surface 107*a* engages the stop lug 107 and pin 105 clears wall 106*e*. Thereafter, continued upward movement of the ball valve will occur without rotation. Such free or lost motion connection of the ball valve and the rotating pin 105 not only relieves the connection of damaging forces when the ball valve is in either of its closed or opened positions, but provides the travel required for full functioning of the valve, as will now be described.

The operation of the invention described above is as follows:

The safety valve is normally closed, as seen in FIGS. 1*a* through 1*d* and in FIG. 8, when the pressure of control fluid in the control fluid pressure chamber 67 is relieved, and the spring 55 biases the piston 60 upwardly. The upward movement of the piston 60 and arms 77, acting through the pivot pins or trunnions 86, carries the ball valve upwardly so that the valve rotating pins 105 engaging the cam surface 106*e* rotate the ball valve to the closed position. Inasmuch as the surface 106*a* clears the pin 105, the ball valve is permitted to have a certain amount of longitudinal overtravel so that it can move into sealing engagement with the resilient seal 91 longitudinally, and without rotation. Upward travel of the seating or sealing sleeve 70 is limited as previously described, and high pressure below the shutoff valve can cause deformation of the arms 77 and axial movement of the ball into engagement with the seal sleeve 76.

Figure 2B:
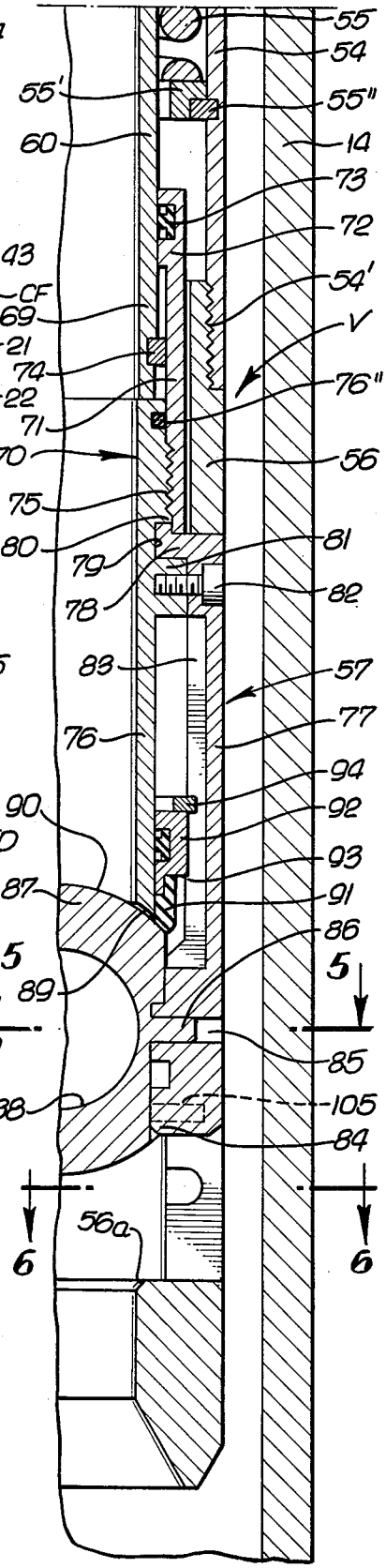

When control fluid pressure is applied to the pressure chamber 67 through the control fluid tubing CF from the top of the well, a downward force is applied to the piston 63 to overcome the force of the spring 55. The piston sleeve 60 can move downwardly relative to the sealing sleeve 76 until the lower end of the piston sleeve 60 engages the upper end 70 on the sealing sleeve 76, as shown in FIG. 2*b*. During this initial increment of downward movement of the piston sleeve 60 differential fluid pressure is equalized when the by-pass ports 99 are opened responsive to wiping of the balls 101 therefrom. As differential pressure across the ball valve drops, a point is reached where the resilience of the previously longitudinally deformed arms overcomes the force of the pressure holding the ball valve against the sealing sleeve. As the arms straighten, the ball valve is pushed away from the sealing sleeve to reopen the small gap normally existing between the ball valve and the sealing sleeve. Thereafter, the valve sealing sleeve 76 and the piston sleeve 60 are moved together by the fluid pressure in the chamber 67 to shift the ball longitudinally and effect its rotation.

Figure 3C:
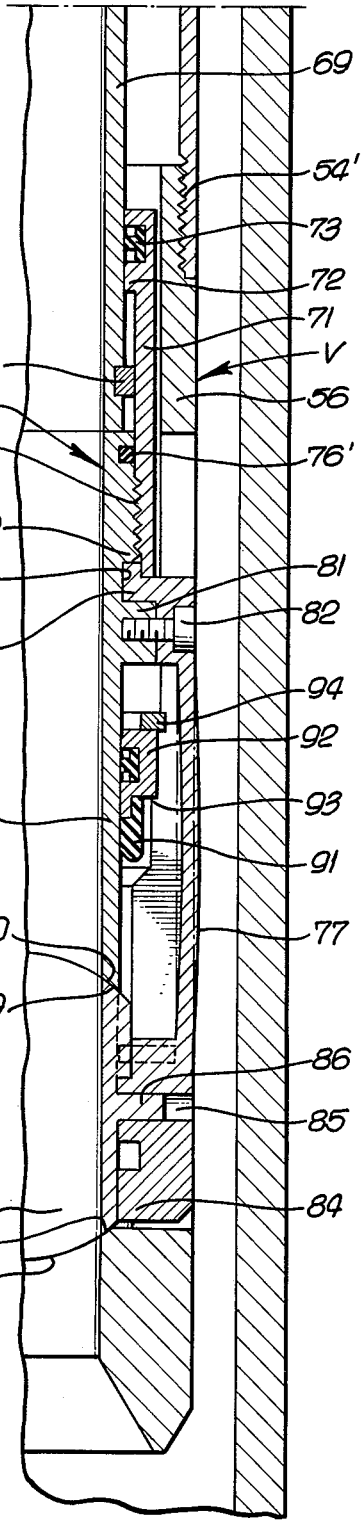
Figure 4:
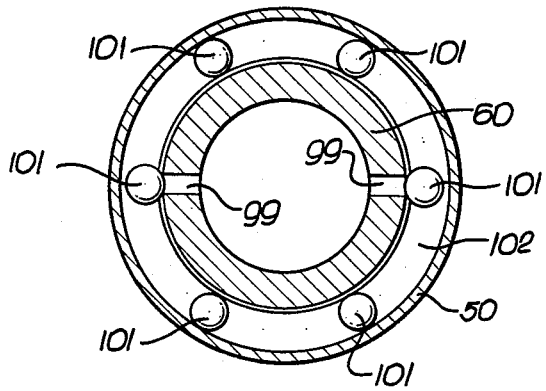
FIG. 4 is a transverse section as taken on the line 4—4 of FIG. 1*b*, showing the equalizing valve means in the closed condition.
Figure 7:
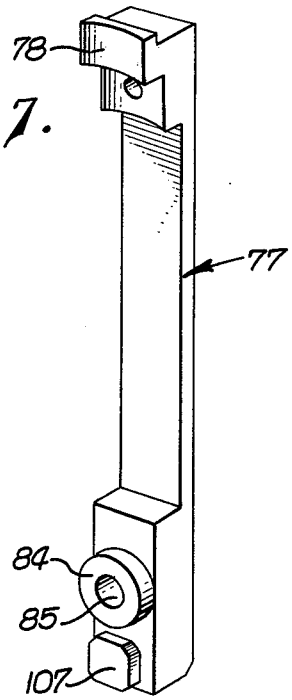
FIG. 7 is a detailed view in perspective illustrating a ball supporting control bar.
Figure 5:
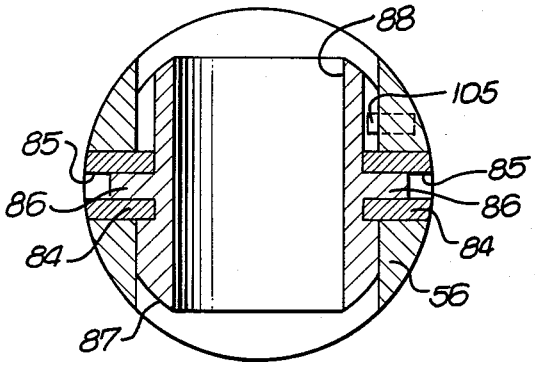
FIG. 5 is a transverse section as taken on the line 5—5 of FIG. 2*b* illustrating the mounting of the main shutoff ball valve.

As the ball valve moves downwardly, the rotating pins 105 will contact the slot surfaces 106*d*, thereby rotating the ball valve from the closed position of FIG. 8 to the open position of FIG. 9, such open position also being shown in FIG. 3*c*, wherein the valve closing spring 55 has been compressed and the spherical sealing surface 89 on the lower valve sealing sleeve 76 and the surface 90 of the ball 87 are sealingly engaged. At this point, further downward movement of the ball valve is prevented by engagement of the ball with the spherical seat 56*a* at the lower end of the cage 56, and the sealing contact between the sealing surfaces of the lower sealing sleeve and the upper sealing surface of the ball valve is maintained by fluid pressure, the arms 77 being bowed outwardly to permit the sealing engagement.

If, for any reason, the control fluid pressure in the pressure chamber 67 acting downwardly on the piston 63 should be relieved, such as by reason of fracture of the control fluid conduit CF or the purposeful venting of the control fluid pressure, the valve closing spring 55 will assist well fluid pressure acting upwardly to overcome any residual control fluid pressure to effect the closing operation by shifting the piston sleeve 60 upwardly, thereby carrying the ball valve therewith for closing actuation of the ball by the ball rotating pins 105.

Referring now to FIGS. 10*a* through 16, the invention is shown as being embodied in a subsurface safety valve of the flap valve type adapted to be installed in a well in the same manner as previously described with respect to the ball type safety valve. In other words, a well packer is set in the casing and forms a lower seal between the production tubing and the casing below the shutoff valve assembly, and the flow of production fluid through the tubing and through the shutoff valve assembly is adapted to be controlled.

This flap valve assembly, like the tubing valve assembly is adapted to be landed in the tubular body 11 or landing nipple. In this form, only the intermediate portion of the landing nipple is illustrated, but it will be understood that the landing nipple will extend upwardly for connection to the upwardly extending tubing T as in FIG. 1*a* and that, at its lower end, the landing nipple body 11 will be connected to the downwardly extending tubular body member 14 which would extend several or thousands of feet downwardly to the packer set below the valve assembly between the tubing and the casing. Here again the shutoff valve assembly generally denoted V lands upon the upwardly facing seat or shoulder 16 of the internal groove 15 of the landing nipple body 11, and latch means 18, as previously described, retain the valve assembly against upward displacement.

As also previously described, the landing nipple 11 has upper and lower sealing bores 19 and 20 between which is the space 21 defined between the nipple and the valve assembly, the landing nipple body 11 also having the port 22 in which is disposed a connector fitting 23 whereby control fluid pressure is supplied to the space 21 through the control fluid supply tubing CF, so that when the valve assembly is seated and latched in the landing nipple body 11, control fluid is applicable to the safety valve to actuate the same.

In this embodiment, the valve assembly V is an elongated assembly which would also be adapted to be run into the landing nipple and retrieved by means of a wireline tool, as is well known, and as has been described above, by means of a head such as the running and retrieving head 29 shown in FIG. 1*a*. Thus, as seen in FIG. 10*a* the latch means 18 includes the latch fingers 32 extending longitudinally in the slots 34 of the latch means 18, the latch fingers having end lugs 36 engageable beneath the downwardly facing shoulder 17 and held in place by the retainer sleeve 38 which is held in its upper position by the compression spring 39. The body 26 of the latch means is threadedly connected at 25 to the upper end 200 of the upper elongated tubular valve body section 201 which extends downwardly within the seating nipple body 11 and which at its lower end 202 is threadedly connected at 203 at the upper end of the equalizing valve housing 204. This equalizing valve housing 204 is a cylindrical body having a threaded connection 205 at its lower end with a downwardly extending tubular spring housing 206 which in turn, at its lower end, is threadedly connected at 207 to the flap type shutoff valve sub-assembly later to be described.

Adjacent the lower end of the spring housing 206 is a lower spring seat 208 supported within the housing 206 by a stop ring 209, and an elongated coiled compression spring 210 seats at its lower end on the spring seat 208. At its upper end, the spring 210 engages an upper spring seat or ring 211 which is engaged beneath the shoulder 212 formed on the outside of an elongated shutoff valve actuator piston sleeve 221 which is slidably disposed within the elongated valve housing assembly.

The upper valve body section 201 constitutes a seal mandrel which supports upper and lower packings 213 and 214, respectively, with the upper packing 213 being disposed between an upwardly facing shoulder 215 on the seal mandrel 201 and the lower end 216 of the latch body 26, and the lower packing 214 being disposed between a downwardly facing shoulder 217 on the seal mandrel 201 and the upper end 218 of the equalizing valve body 204. When the valve is landed in the nipple body 11, as illustrated, the packings 213 and 214 straddle the space 21 into which control fluid from the control fluid tubing CF is admitted. In addition, the seal mandrel 201 between the packings 213 and 214 has a one or a plurality of radial ports 219 which lead between the pressure fluid space 21 and the annular piston chamber 220 defined between the upper reduced diameter end section of the piston sleeve 221 and a piston or shoulder 222 which is slidably disposed within the bore of the seal mandrel 201. Sealing means are provided between the piston sleeve 221 and the seal mandrel 201, comprising an upper side ring seal 223 carried by the seal mandrel and slidably engaged with the upper end of the piston sleeve 221 and a lower side ring seal 224 carried by the piston sleeve and slidably engaging the lower portion of the valve body section or seal mandrel 201.

Thus, it is apparent that control fluid pressure supplied to the piston chamber 220 and acting on the annular piston 222 can force the piston sleeve 221 downwardly against the bias of the spring 210 which normally holds the piston sleeve 221 in an upper position, in which, as seen in FIGS. 10*a* through 10*c*, the shutoff valve now to be described is in a closed condition.

The flap valve assembly FV comprises a tubular valve body 224 threaded, as previously indicated, at 207 to the lower end of the spring housing 206. At its lower end the shutoff valve body 224 has a lower nose 225 forming a lower flow passage 226 circumscribed by an enlarged seating bore 227, adapted as will be later described to receive the lower end extremity of the piston sleeve 221. Threaded into the upper end of the shutoff valve body 224 as at 228 is a cylindrical sealing and seating sleeve 229 having an upper internal side ring seal 230 slidably and sealingly engaging the lower end of the piston sleeve 221. At its lower end, the sealing and seating sleeve 229 has an annular elastomeric seating and sealing ring 231 disposed in an annular groove 232 in the lower end of the seating sleeve 229 and opening at the lower end thereof, so that the sealing ring 231 projects downwardly therefrom. In addition, internally of the sealing ring 231 the end of the seating sleeve 229 has a beveled seating surface 233.

At one side of the shutoff valve body 224 is a side opening or pocket 234 having centrally thereof an upwardly extended slot 235 adapted to receive a hinge lug 236 formed on a flap valve member 237, whereby the flap valve member is adapted to be pivotally supported on a hinge pin 238 which extends chordally through the chordal opening 239 drilled through the valve body 224 and intersecting the slot 235. Torsion springs 240 on opposite sides of the hinge lug 236 are disposed about the hinge pin 238 and suitably anchored against the valve body at 241 and against the underside of the valve flap member 237, whereby the valve flap is normally spring loaded to the closed position of FIG. 10*c*.

The flap valve 237 has a configuration adapting it to be received within the side opening or pocket 234 in the valve body 224 and has a partly cylindrical outer surface form 242 conforming to the cylindrical shape of the valve body 224 when the valve is in the open position shown in FIG. 12*c*. The valve flap 237 is also provided with a circular marginal seating surface 243 for complemental engagement with the beveled seating surface 233 at the lower end of the sealing and seating sleeve 229. In addition, the flap 237 is formed with a pair of diametrically opposite projections 244 having upper end surfaces 245, when the valve is in the closed position, disposed in the path of the lower end surface 246 of the piston sleeve 221, as will be later described, and between those projections 244 the flap is formed with the partly cylindrical concavity 247, best seen in FIG. 16, conforming to the outer cylindrical shape of the piston sleeve 221 when the valve flap 237 is in the open position, as seen in FIGS. 12 and 16.

When the flap valve is closed as just described, it is desired that the fluid pressure across the flap valve tending to hold it closed be equalized before opening of the flap valve commences, so as to minimize resistance to actuation of the valve to the open condition. In accordance with the present invention, as will now be described, the equalization of fluid pressure across the shutoff valve is accomplished during an initial increment of movement of the actuator piston sleeve 221 in a downward direction in response to the application of control fluid pressure to the control fluid pressure chamber 220.

As previously indicated, the tubular valve body assembly comprises as one of its tubular components the equalizing valve housing 204 previously referred to. The equalizing valve housing 204 has between its ends one or a number of circumferentially spaced radial ports 248 which lead from the annular space 249 between the landing nipple body 11 and the equalizing valve housing below the lower packing 214, to expose the port or ports 248 to the pressure of fluid in the well. An annular groove 250 within the housing 204 establishes communication between the ports 248. The actuator piston sleeve 221 has a number of by-pass or equalization ports 251 formed in circumferentially spaced relation and extending radially therethrough and adapted, depending upon the longitudinal position of the actuator sleeve or piston 221, to be either closed by ball means 252, as seen in FIG. 10, or to be in communication with the housing ports 248, as shown in FIG. 11*a*. Ball means 252 comprises a plurality of suitable spherical beads or balls 253, say, of metal, plastic, glass, or other material capable of withstanding the substantial differential pressure between the fluid in the well below the flap valve 237 and the fluid in the piston sleeve 221. The balls or beads 253 are confined between the piston sleeve 221 and the equalizing valve housing 204 in a groove 254 which extends circumferentially of the housing 204 and is defined between an upper annular shoulder 255 and a lower annular shoulder 256 provided by the housing 204. The lower shoulder 256 is formed on an angle sloping downwardly and outwardly from the inside diameter of the housing 220. These balls 253 are loosely disposed within the groove 254 so as to be relatively free for movement circumferentially and axially of the groove, and fluid entering the groove through the housing ports 248 and passing into the ball containing groove 254 and then through the piston ports 251 will carry one of the balls into seating engagement against the piston sleeve at each of the port or ports 251, causing an effective seal preventing communication of fluid from below the closed flap valve 237 into the piston sleeve 221. However, when the piston sleeve 221 is moved downwardly for the purpose of initiating opening of the flap valve 237, the seated balls or beads 253 will be brushed or pushed from the piston ports 251 upon contact with the upwardly facing shoulder 256. The slope of the shoulder 256 assists in causing the removal of the balls 253 from the ports 251 in that it has a positive slope. Moreover, the flow of fluid through the equalizing ports 248 and 251, as well as through the ball containing groove 254, during equalization of the pressure across the shutoff valve performs a cleansing action so that the balls and the ball seat provided by the piston sleeve will be at all times clean and an effective closure can be accomplished.

When the shutoff valve assembly is in the open condition of FIGS. 12*a* through 12*c*, as will be later described, it is desired that no fluid pass through the equalizing ports 248 in the housing 204 and 251 in the piston sleeve 221 in any direction. Accordingly, the piston sleeve 221 is provided below the equalizing ports 251 with a pair of axially spaced sealing portions 356 and 357 respectively carrying side ring seals 258 and 259 slidably and sealingly engaged with a cylindrical section 260 of the piston sleeve 221, these seal rings 258 and 259 straddling the piston ports 251 when the piston sleeve 221 is in its lowermost position as seen in FIG. 12*b*, and the flap valve is open.

The operation of this form of the invention is as follows:

The shutoff valve according to this embodiment is normally in the closed condition as illustrated in FIGS. 10*a* through 10*c*. Control fluid pressure is supplied through the control tubing F to the control fluid pressure chamber 220 where it acts upon the annular piston 222 of the piston sleeve 221 to urge the piston sleeve downwardly against the upward bias of the return spring 210. The flap valve 237 may be held against its seat 233 by substantial differential pressure, and in order to equalize such differential pressure before the flap valve 237 is actuated to the open position, the initial increment of movement of the piston sleeve 221 downwardly from the position of FIGS. 10*a* through 10*c* to the position of FIGS. 11*a* and 11*b* will cause the lower shoulder 256 of the equalizing valve housing 204 to engage the seated balls 253 and brush or roll them from seating engagement at the by-pass ports 251. When the balls 253 are unseated, communication is established between the interior of the piston sleeve 221 and the exterior of the valve assembly below the lower packing 214 between the valve assembly and the landing nipple body 11. Such equalization of the differential pressure across the flap valve 237 is accomplished by the downward movement of the piston sleeve 221 which also acts to thereafter open the flap valve 237. Referring to FIGS. 11*a* and 11*b*, it will be noted that the by-pass valve means 252 is open and that the lower end surface 246 has just arrived at a position of engagement with the upper surfaces 245 of the spaced projections 244 on top of the flap valve 237. The projection of the upper surfaces 245 from the axis of the hinge pin 238 for the lug 236 of the flap valve 237 effectively provides a relatively long lever arm on which the lower end 246 of the piston sleeve 221 acts in swinging the flap valve 237 toward the open position, thereby minimizing shear loading on the pivot pin 238.

As downward movement of the piston sleeve 221 progresses the flap valve 237 is progressively moved downwardly and outwardly about its pivot point into the window 234 in the flap valve body 224 to the full open position of FIG. 12*c*, and, as best seen in FIG. 16, the lower end portion of the piston sleeve 221 extends through the concavity 247 of the flap valve 237 and downwardly into the seat 227 at the base of the valve housing 224.

With the flap valve in the full open position of FIG. 12*c*, it will be seen, upon reference to FIG. 12*b*, that the by-pass ports 251 in the piston sleeve 221 are straddled by the side ring seals 258 and 259, so that no fluid flow can occur through such ports. When control fluid pressure in the control tubing C is relieved for any reason, such as damage at the wellhead or at some underwater location, in the case of an offshore well, or purposely when it is desired to shut the well in, the return spring 210 within the housing 206, acts upwardly on the piston sleeve 221 to shift the latter upwardly to the position shown in FIGS. 10*a* through 10*c*, and as the lower end of the piston sleeve clears the flap valve 237, the torsion spring means 240 will bias the flap valve 237 back to the closed position. Any well fluid pressure then present will create a differential across the closed flap valve holding it in tight sealing engagement with its seat.

From the foregoing it will now be apparent that the present invention provides a subsurface safety valve of the automatic closing type, wherein the first increment of movement of the control fluid responsive actuator piston, which is utilized for opening the shutoff valve, will effectively cause the opening of the equalizing valve as the equalizing port closing balls or beads are wiped or rolled from the by-pass ports of the actuator piston sleeve. Since very little additional force is required to remove the balls or beads from the by-pass ports of the piston sleeve, substantially all of the force applied by the piston is applicable to the compression of the return springs and the overcoming of other frictional resistance to opening of the valve. Frictional resistance to opening of the ball type valve is minimized or reduced immediately upon equalizing of the differential pressure thereacross, as the control bars which support the ball valve flex to a normal condition and slightly shift the ball sealing sleeve from actual engagement with the ball. In the case of the flap valve, the extension of the effective lever arm between the lower end of the actuator piston sleeve and the pivot for the flap valve tends to reduce the total force required to be applied by the control fluid pressure in the pressure chamber for the actuator piston sleeve.

I claim:

1. In a subsurface shutoff valve for wells adapted to be supported in a well fluid production pipe: a tubular body having a flow passage therethrough; shutoff valve means including a valve member shiftable between a first position closing said passage and a second position at which said passage is open; actuator means for shifting said valve member between said positions, including a piston sleeve in said body; said piston sleeve and said body defining a control fluid pressure chamber therebetween for moving said piston sleeve longitudinally in said body in one direction in response to the pressure of control fluid in said chamber; equalizing valve means for equalizing well fluid across said valve member upon control fluid responsive movement of said piston sleeve; said equalizing valve means including by-pass port means in said piston sleeve and by-pass port means in said body, axially spaced shoulders on one of said piston sleeve and said body defining a circumferentially extended groove communicating with one of said port means, and ball means loosely disposed in said groove to seat in the other of said port means responsive to well fluid pressure; one of said shoulders wiping said ball means from said other of said port means upon control fluid responsive movement of said piston sleeve to allow communication between said port means; means for moving said valve member to said second position from said first position upon further control fluid responsive movement, of said piston sleeve following equalization of well fluid across said valve member; means for effecting return movement of said piston sleeve upon reduction of said control fluid pressure; and means for moving said valve member to said first position from said second position upon return movement of said piston sleeve.

2. In a subsurface shutoff valve for wells as defined in claim 1; said circumferentially extended groove being annular, and said ball means comprising a plurality of balls free for circumferential relative movement in said groove.

3. In a subsurface shutoff valve for wells as defined in claim 1; said circumferentially extended groove being annular, and said ball means comprising a plurality of balls free for circumferential relative movement in said groove, said balls also being free for axial movement between said shoulders.

4. In a subsurface shutoff valve as defined in claim 1; said one of said shoulders being inclined at a positive angle to remove said ball means from said one of said ports.

5. In a subsurface shutoff valve for wells as defined in claim 1; said circumferentially extended groove being annular, and said ball means comprising a plurality of balls free for circumferential relative movement in said groove, said balls also being free for axial movement between said shoulders, said one of said shoulders being inclined at a positive angle to remove said balls from said other of said port means.

6. In a subsurface shutoff valve as defined in claim 1; said valve member being a ball valve having a flow passage therethrough; said means for moving said valve member to said second position including support means for said ball valve and means for rotating said ball valve to align said flow passage therethrough with said flow passage through said body.

7. In a subsurface shutoff valve as defined in claim 1; said valve member being a flap valve hingedly connected to said body at one side thereof; said means for moving said valve member to said second position including coengageable surfaces on said piston sleeve and said flap valve for swinging said flap valve to said one side of said body.

8. In a subsurface shutoff valve for wells as defined in claim 1; said valve member being a ball valve, said means for moving said valve member to said second position including a sealing sleeve supporting said ball valve for rotative movement and for slight movement of said ball longitudinally of said sealing sleeve for seating coengagement therebetween when said ball valve is in said first position.

9. In a subsurface shutoff valve for wells as defined in claim 1; said valve member being a ball valve, said means for moving said valve member to said second position including a sealing sleeve supporting said ball valve for rotative movement and for slight movement of said ball longitudinally of said sealing sleeve for seating coengagement therebetween when said ball valve is in said first position and in said second position.

10. In a subsurface shutoff valve for wells as defined in claim 1; said valve member being a ball valve, said means for moving said valve member to said second position including a sealing sleeve supporting said ball valve for rotative movement and for slight movement of said ball longitudinally of said sealing sleeve for seating coengagement therebetween when said ball valve is in said first position, and including a resilient seal ring carried by said body and engageable with said sealing sleeve and said ball valve when said ball valve is in said first position.

11. In a subsurface shutoff valve for wells as defined in claim 1; said valve member being a ball valve, said means for moving said valve member to said second position including a sealing sleeve supporting said ball valve for rotative movement and for slight movement of said ball longitudinally of said sealing sleeve for seating coengagement therebetween when said ball valve is in said first position, said sealing sleeve having opposed elongated bars connected at one end to said sleeve and supporting said ball valve at the other end, said bars being longitudinally flexible to allow longitudinal movement of said sealing sleeve into end seating coengagement with said ball valve.

12. In a subsurface shutoff valve for wells as defined in claim 1; said valve member being a ball valve, said means for moving said valve member to said second position including a sealing sleeve supporting said ball valve for rotative movement and for slight movement of said ball longitudinally of said sealing sleeve for seating coengagement therebetween when said ball valve is in said first position and in said second position, said sealing sleeve having opposed elongated bars connected at one end to said sleeve and supporting said ball valve at the other end, said bars being longitudinally flexible to allow longitudinal movement of said sealing sleeve into end seating coengagement with said ball valve in said first position and in said second position.

13. In a subsurface shutoff valve for wells as defined in claim 1; said means for moving said valve member to said second position including a sealing sleeve shiftably supporting said valve member and disposed in the path of said piston sleeve to be engaged and shifted thereby following communication between said port means, and means for moving said valve member to said second position responsive to such shifting of said sealing sleeve.

14. In a subsurface shutoff valve for wells as defined in claim 1; said means for moving said valve member to said second position including a sealing sleeve shiftably supporting said valve member and disposed in the path of said piston sleeve to be engaged and shifted thereby following communication between said port means, and means for moving said valve member to said second position responsive to such shifting of said sealing sleeve, said means for moving said valve member to said first position including means responsive to return movement of said sealing sleeve.

15. In a subsurface shutoff valve for wells as defined in claim 1; said means for moving said valve member to said second position including a sealing sleeve shiftably supporting said valve member and disposed in the path of said piston sleeve to be engaged and shifted thereby following communication between said port means, and means for moving said valve member to said second position responsive to such shifting of said sealing sleeve, said means for moving said valve member to said first position including means responsive to return movement of said sealing sleeve, and coengageable means on said piston sleeve and said sealing sleeve to effect return movement of said sealing sleeve upon return movement of said piston sleeve.

16. In a subsurface shutoff valve for wells as defined in claim 1; said means for moving said valve member to said second position including abutment means on said valve member disposed in the path of said piston sleeve.

17. In a subsurface shutoff valve for wells as defined in claim 1; said means for moving said valve member to said second position including abutment means on said valve member disposed in the path of said piston sleeve, and said means for moving said valve member to said first position including a spring acting on said valve member.

18. In a subsurface shutoff valve as defined in claim 1; axially spaced sealing means between said piston sleeve and said body straddling said other of said port means when said valve member is in said second position.

19. In a subsurface shutoff valve as defined in claim 1; axially spaced sealing means between said piston sleeve and said body straddling said other of said port means when said valve member is in said second position, said axially spaced sealing means comprising elastomeric seal rings carried by one of said piston sleeve and said body and cylindrical sealing surfaces at opposite sides of said other of said port means slidably and sealingly engaged by said seal rings.

20. In a subsurface shutoff valve for wells adapted to be supported in a well fluid production pipe: a tubular body having a flow passage therethrough; shutoff valve means including a ball valve rotatable between a first position closing said passage and a second position at which said passage is open; actuator means for rotating said ball valve between said positions, including a piston sleeve; said piston sleeve and said body defining a control fluid pressure chamber therebetween for moving said piston sleeve longitudinally in said body in one direction in response to the pressure of control fluid in said chamber; a sealing sleeve in said body; means connecting said sealing sleeve to said piston sleeve for limited relative longitudinal movement; equalizing valve means openable for equalizing fluid across said ball valve responsive to movement of said piston sleeve in said one direction; said sealing sleeve being disposed for engagement by and movement with said piston sleeve following opening of said equalizing valve means; means connecting said ball valve to said sealing sleeve for longitudinal movement therewith; means for rotating said ball valve between said positions responsive to longitudinal movement of said ball valve in opposite directions; said means connecting said ball valve to said sealing sleeve including means enabling well pressure responsive movement of said ball valve relative to said sealing sleeve into abutting engagement therebetween when said ball valve is in said first position.

21. In a subsurface shutoff valve for wells as defined in claim 20; said means connecting said ball valve to said sealing sleeve comprising a pair of diametrically spaced elongated and longitudinally resiliently deformable control bars connected at one end of said sealing sleeve, means at the other end of said control bars rotatably mounting said ball valve, and abutment means limiting longitudinal movement of said control bars when said ball valve is in said first position, whereby pressure differential across said ball valve longitudinally deforms said control bars.

22. In a subsurface shutoff valve for wells as defined in claim 21; said sealing sleeve and said ball valve having opposing spherical surfaces coengageable upon longitudinal deformation of said control bars.

23. In a subsurface shutoff valve for wells as defined in claim 21; a resilient seal carried by said body and engageable with said ball valve and said sealing sleeve when said ball valve is in said first position.

24. In a subsurface shutoff valve for wells as defined in claim 21; said sealing sleeve and said ball valve having oppoising spherical surfaces coengageable upon longitudinal deformation of said control bars, a resilient seal carried by said body and engageable with said ball valve and said sealing sleeve when said ball valve is in said first position.

25. In a subsurface shutoff valve as defined in claim 21; said means connecting said ball valve to said sealing sleeve comprising a pair of diametrically spaced elongated and longitudinally resiliently deformable control bars connected at one end to said sealing sleeve, means at the other end of said control bars rotatably mounting said ball valve, abutment means limiting longitudinal movement of said control bars when said ball valve is in said first position, whereby pressure differential across said ball valve longitudinally deforms said control bars, and additional abutment means engageable by said ball valve when said ball valve is in said second position, whereby control fluid pressure acting on said piston sleeve longitudinally deforms said control bars enabling control fluid pressure responsive movement of said sealing sleeve into engagement with said ball valve.

26. In a subsurface shutoff valve for wells adapted to be supported in a well fluid production pipe: a tubular body having a flow passage therethrough; shutoff valve means including a ball valve rotatable between a first position closing said passage and a second position at which said passage is open; actuator means for rotating said ball valve between said positions, including piston sleeve means; said piston sleeve means and said body defining a control fluid pressure chamber therebetween for moving said piston sleeve means longitudinally in said body in one direction in response to the pressure of control fluid in said chamber; means connecting said ball valve to said piston sleeve means for longitudinal movement therewith; means for rotating said ball valve between said positions responsive to longitudinal movement of said ball valve in opposite directions; said means connecting said ball valve to said piston sleeve means including means enabling well pressure responsive movement of said ball valve relative to said piston sleeve means into abutting engagement therebetween when said ball valve is in said first position.

27. In a subsurface shutoff valve for well as defined in claim 22; said means connecting said ball valve to said piston sleeve means comprising a pair of diametrically spaced elongated and longitudinally resiliently deformable control bars connected at one end to said piston sleeve means, means at the other end of said control bars rotatably mounting said ball valve, and abutment means limiting longitudinal movement of said control bars when said ball valve is in said first position, whereby pressure differential across said ball valve longitudinally deforms said control bars.

28. In a subsurface shutoff valve as defined in claim 22; said means connecting said ball valve to said piston sleeve means also enabling control fluid pressure responsive movement of said piston sleeve means relative to said ball valve into abutting engagement therebetween when said ball valve is in said second position.

29. In a subsurface shutoff valve for wells as defined in claim 22; said piston sleeve means and said ball valve having opposing spherical surfaces coengageable upon longitudinal deformation of said control bars, and including a resilient seal carried by said housing and engageable with said ball valve and said piston sleeve means when said ball valve is in said first position.

30. In a valve assembly: a pair of relatively longitudinally shiftable cylindrical members; radial port means in each of said members, one of said members having an annular groove defined between axially spaced opposed shoulders and communicating with the port means thereof; a plurality of balls loosely disposed in said groove; and means for relatively shifting said members longitudinally from a first position at which said balls close said port means of the other of said cylindrical members to a second position at which one of said shoulders pushes said balls from the last mentioned port means and fluid can flow through said port means and said groove.

31. In a valve assembly as defined in claim 26, axially spaced sealing means between said cylindrical members spaced longitudinally from said port means to prevent fluid flow through said port means upon further relative longitudinal movement of said members.

32. In a valve assembly as defined in claim 26; said one of said shoulders being inclined at a positive angle for pushing said balls from said last mentioned port means.

33. In a valve assembly as defined in claim 26; said balls being loosely spaced circumferentially of said groove.

34. In a valve assembly as defined in claim 26; said balls being loosely spaced circumferentially of said groove and axially of said groove.

35. In a valve assembly: an outer tubular body, an inner reciprocable valve piston; means defining a piston chamber between said piston and said body to receive pressure fluid to shift said member longitudinally of said body from a first position to a second position; said body and said piston having radial port means; a circumferential groove in one of said body and said piston communicating with its port means; a number of balls loosely disposed in said groove to seat in the port means of the other of said body and said piston when said body and said piston are in said first position with said groove confronting the last mentioned port means, said groove having a radial shoulder at one end for brushing said balls from said last mentioned port means upon movement of said member to said second position to allow flow between said port means.

36. In a valve assembly as defined in claim 35; said body and piston having axially spaced sealing means straddling said port means in said piston when said piston is in said second position.

37. In a valve assembly as defined in claim 36; said balls being loose in said groove circumferentially, axially and radially of said groove.

* * * * *